US007313880B2

(12) United States Patent
Yamagishi

(10) Patent No.: US 7,313,880 B2
(45) Date of Patent: Jan. 1, 2008

(54) CONNECTING DEVICE FOR FRAME MEMBERS OF FRAME

(75) Inventor: Yuji Yamagishi, Saitama (JP)

(73) Assignee: Daisan Co., Inc., Saitama (JP)

( * ) Notice: Subject to any disclaimer, the term of this patent is extended or adjusted under 35 U.S.C. 154(b) by 395 days.

(21) Appl. No.: 10/893,834

(22) Filed: Jul. 19, 2004

(65) Prior Publication Data

US 2005/0016047 A1 Jan. 27, 2005

(30) Foreign Application Priority Data

Jul. 23, 2003 (JP) ..... 2003-278671
May 20, 2004 (JP) ..... 2004-150578

(51) Int. Cl.
*A47G 1/10* (2006.01)

(52) U.S. Cl. ..... 40/782; 40/783; 40/780

(58) Field of Classification Search ..... 40/782, 40/779; 248/479

See application file for complete search history.

(56) References Cited

U.S. PATENT DOCUMENTS 4,348,826 A * 9/1982 Reim ..... 40/782
5,159,770 A * 11/1992 Yamaguchi ..... 40/790
5,189,820 A * 3/1993 Komamura ..... 40/782

FOREIGN PATENT DOCUMENTS

JP 9-164048 6/1997
JP 10-295509 11/1998

* cited by examiner

*Primary Examiner*—Lesley D. Morris
*Assistant Examiner*—Christopher E Veraa
(74) *Attorney, Agent, or Firm*—Notaro & Michalos P.C.

(57) ABSTRACT

A connecting device for frame members of a frame which facilitates setting and replacement of a showpiece to the frame particularly by devising how to attach a corner member and a frame member is provided. A connecting device for connecting each corner portion of a plurality of frame members constituting a frame such as a picture frame, a poster frame, a jigsaw puzzle frame, and so on is constituted of: a base to which an end portion of each of the frame members is attached to be rotatable in a direction perpendicular to an axial direction thereof; a locking means attached to the base for locking each frame member in an inwardly closed state; and a corner member with a smoothed corner which forms each corner portion of the frame, wherein the corner member is swingably attached to the base. The present invention can also employ all or part of a closing stop means for stopping the frame member at a predetermined position when it is closed to the base; an opening stop means for stopping the frame member at a predetermined position when it is opened from the base; and a stop means for stopping the frame member at a predetermined position when it is closed.

12 Claims, 24 Drawing Sheets

CONNECTING DEVICE FOR FRAME MEMBERS OF FRAME

FIELD AND BACKGROUND OF THE INVENTION

The present invention relates to a connecting device for frame members constituting a frame such as a picture frame for pictures and photographs, a poster frame on which a poster is put, a jigsaw puzzle frame for exhibiting a completed jigsaw puzzle, and so on.

DESCRIPTION OF THE RELATED ART

In place of frames such as a picture frame, a poster frame, and so on into which a showpiece is placed by fitting the showpiece together with a transparent plate and a retaining plate into a fixing frame in a planar quadrilateral or triangular shape from its back face and securing the retaining plate through use of engaging pieces attached to the rear side of the frame members of the fixing frame to prevent falling off of the showpiece, such many frames are recently available that are configured such that end portions of frame members constituting the frame are connected to a base to be openable thereto/closable therefrom to allow a showpiece to be attached to/detached from the frame at the front face of the frame by opening the frame members.

Well-known ones having the above-type configuration are disclosed, for example, in the following patent documents.

(Patent Document 1) Japanese Patent Application Laid-open No. Hei 09-164048

(Patent Document 2) Japanese Patent Application Laid-open No. Hei 10-295509

Of them, a frame disclosed in Patent Document 1, in which a corner portion is formed by cutting end portions of frame members at an angle of 45° and butting their end portions, has a problem that when this frame is held by a hand, this resultant corner portion which is necessarily made sharp is likely to hurt the hand and another problem that it takes much time to carry out an assembly work of the frame members to the base.

Therefore, a frame disclosed in Patent Document 2 is proposed. The frame in Patent Document 2 is configured such that a corner member with a cap having a corner portion smoothed is provided on a base constituting a connecting device, and the cap is removed to allow placement and replacement of the showpiece from the front side of the frame when setting and replacing the showpiece, but has a problem that it is necessary to perform troublesome removal of caps from a plurality of corner members one by one and another problem that it takes much time to carry out an assembly work of the frame members to the corner members.

Further, the frames described in Patent Documents 1 and 2 have drawbacks and need improvement in the configuration of a connecting means for connecting the frame member to the base, an engaging means for stopping the frame member at the base in a closed state to fix the showpiece, a closing stop means for arresting the frame member to the base to prevent the frame member in the open state from free-falling, and so on.

SUMMARY OF THE INVENTION

An object of the present invention is to provide a connecting device for frame members of a frame which facilitates assembly of the frame member to a corner member and setting and replacement of a showpiece to the frame by devising the corner member.

Another object of the present invention is to provide a connecting device for frame members further improved by a connecting means of the frame member to a base, an engaging means and an opening stop means for fixedly arresting the frame member to the base when opening and closing the frame member, and so on.

To achieve the above objects, the present invention is a connecting device for connecting each corner portion of a plurality of frame members constituting a frame such as a picture frame, a poster frame, a jigsaw puzzle frame, and so on, which is characterized by comprising: a base to which an end portion of each of the frame members is attached to be rotatable in a direction perpendicular to an axial direction thereof; an engaging means attached to the base for locking each frame member in an inwardly closed state; and a corner member with a smoothed corner which forms each corner portion of the frame, wherein the corner member is swingably attached to the base while being arrested to each end portion of the frame member.

In this event, in the present invention, it is possible that the corner member is configured to be automatically opened when the arrested effect of the end portion of the frame member is released.

The present invention can also be configured such that the corner member has an arresting piece arrested to the end portion of the frame member, and engagement between the arresting piece and the end portion of the frame member is not released when the corner member and the frame member are opened.

It is also possible that the present invention further comprises, between the frame member and the base, a closing stop means for stopping the frame member at a predetermined closed position, the closing stop means being a stopper piece which is provided to protrude from the base and butts against the frame member.

The present invention is characterized by further comprising, between the frame member and the base, an opening stop means for stopping the frame member at a predetermined open position, the opening stop means comprising a pivotal attachment recess of the frame member and an extended portion for forming on the base a hinge shaft portion for pivotally attaching the pivotal attachment recess thereto.

The present invention is characterized by further comprising means for preventing the frame member pivotally attached to the hinge shaft portion from slipping off in an axial direction from the hinge shaft portion, the means being provided between the hinge shaft portion and the frame member.

The present invention is characterized in that the base is provided with an abutting portion to which the end portion of the frame member butts.

The present invention is characterized by further comprising, between the base and the corner member, an opening stop means for stopping the corner member at a predetermined open position, wherein the opening stop means is constituted from an engaging tongue piece attached to the corner member and having an engaging portion at a tip thereof and an engagement guide portion provided on the base side for guiding and arresting the engaging tongue piece.

The present invention is characterized by further comprising, between the frame member and the base, an opening stop means for stopping the frame member at a predetermined open position, wherein the opening stop means is constituted of an engaging portion provided at a tip of a partition of the frame member and an arresting piece provided on the base to engage with the engaging portion.

The present invention is also a connecting device for connecting each corner portion of a plurality of frame members constituting a frame such as a picture frame, a poster frame, a jigsaw puzzle frame, and so on, which is characterized by comprising: a base to which an end portion of each of the frame members is attached to be rotatable in a direction perpendicular to an axial direction thereof; an engaging means attached to the base for locking each frame member in an inwardly closed state, wherein the engaging means is constituted of an engaging portion provided on a free end side of a partition of the frame member and a first engaging protruding piece erected from the base to engage with the engaging portion.

In the above, in the present invention, the engaging portion provided on a free end side of a partition of the frame member can be provided inside the partition.

The present invention is also a connecting device for connecting each corner portion of a plurality of frame members constituting a frame such as a picture frame, a poster frame, a jigsaw puzzle frame, and so on, which is characterized by comprising: a base to which an end portion of each of the frame members is attached to be rotatable in a direction perpendicular to an axial direction thereof; an engaging means attached to the base for locking each frame member in an inwardly closed state; and an opening stop means for stopping the frame member in an open state, wherein the opening stop means is constituted of a pivotal attachment recess of the frame member and an extended portion for forming on the base a hinge shaft portion for pivotally attaching the pivotal attachment recess thereto.

In this event, in the present invention, the opening stop means can be constituted of an engaging projection provided on a pivot guide portion of the base and an engaging portion provided inside a tip of a partition of the frame member to engage with the engaging projection at a predetermined open angle.

In the present invention, the opening stop means can be constituted of an engaging portion provided at a tip of a partition of the frame member and an arresting piece provided to protrude in a horizontal direction on the base to engage with the engaging portion.

The present invention configured as described above and has therefore the following effects.

The configuration can produce an effect of facilitating setting and replacing work of a showpiece because the corner member is made an independent member with its corner rounded off and is safe since there is no possibility of hurting a hand by a sharp end portion of a frame member when handling of the frame, and the corner member is openable together with an expanding operation of the frame member.

The configuration can produce an effect of increasing the convenience because the corner member, even though not touched by a hand, is automatically opened/closed together with the opening/closing operation of the frame member.

The configuration can produce an effect of fixing the open position and closed position of the frame member which is opened/closed by a simple configuration.

The configuration can produce an effect capable of preventing the frame member connected to the connecting device to be openable/closable from slipping off in the axial direction and disassembling by a simple configuration.

The configuration can produce an effect of determining by an abutting portion the attachment position of the frame member to be attached to the base to facilitate the assembly work of the frame member to the corner member, and being capable of forming the frame in an accurate rectangular shape.

The configuration can produce an effect of facilitating the assembly work of the frame member to the base because the open position of the corner member is determined.

The configuration can produce an effect of facilitating the assembly work of the frame member to the corner member because the assembly can be performed even though each of the frame members is not slid in the longitudinal direction with respect to the corner member.

The configuration allows the frame member to be locked when it is closed by a simple configuration and the showpiece to be secured between the frame member and the base at the same time.

The configuration can produce an effect of eliminating provision of another closing stop means because the engaging portion constitutes a closing stop means of the frame member at the same time.

The configuration can produce an effect of simplifying the configuration of the opening stop means because the pivotal attachment recess constitutes an opening stop means between the pivotal attachment recess and the extended portion.

The configuration can produce an effect of simplifying the pivotal structure of the frame member.

DETAILED DESCRIPTION OF THE PREFERRED EMBODIMENTS

Hereinafter, preferred embodiments of the present invention will be described in detail with reference to the drawings.

First Embodiment

Figure 1:
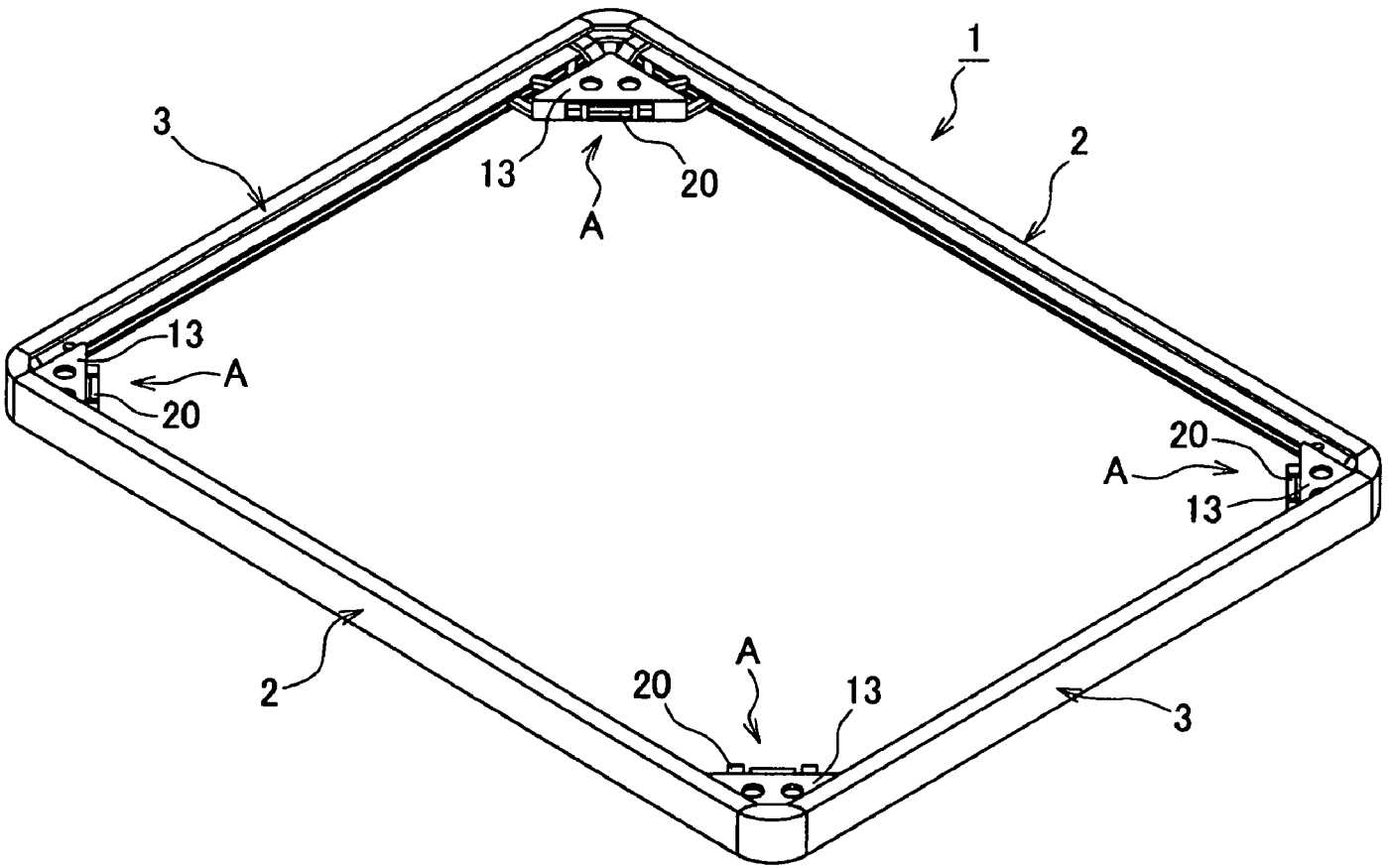
FIG. 1 is a perspective view of a frame using connecting devices for frame members according to the present invention.
Figure 2:
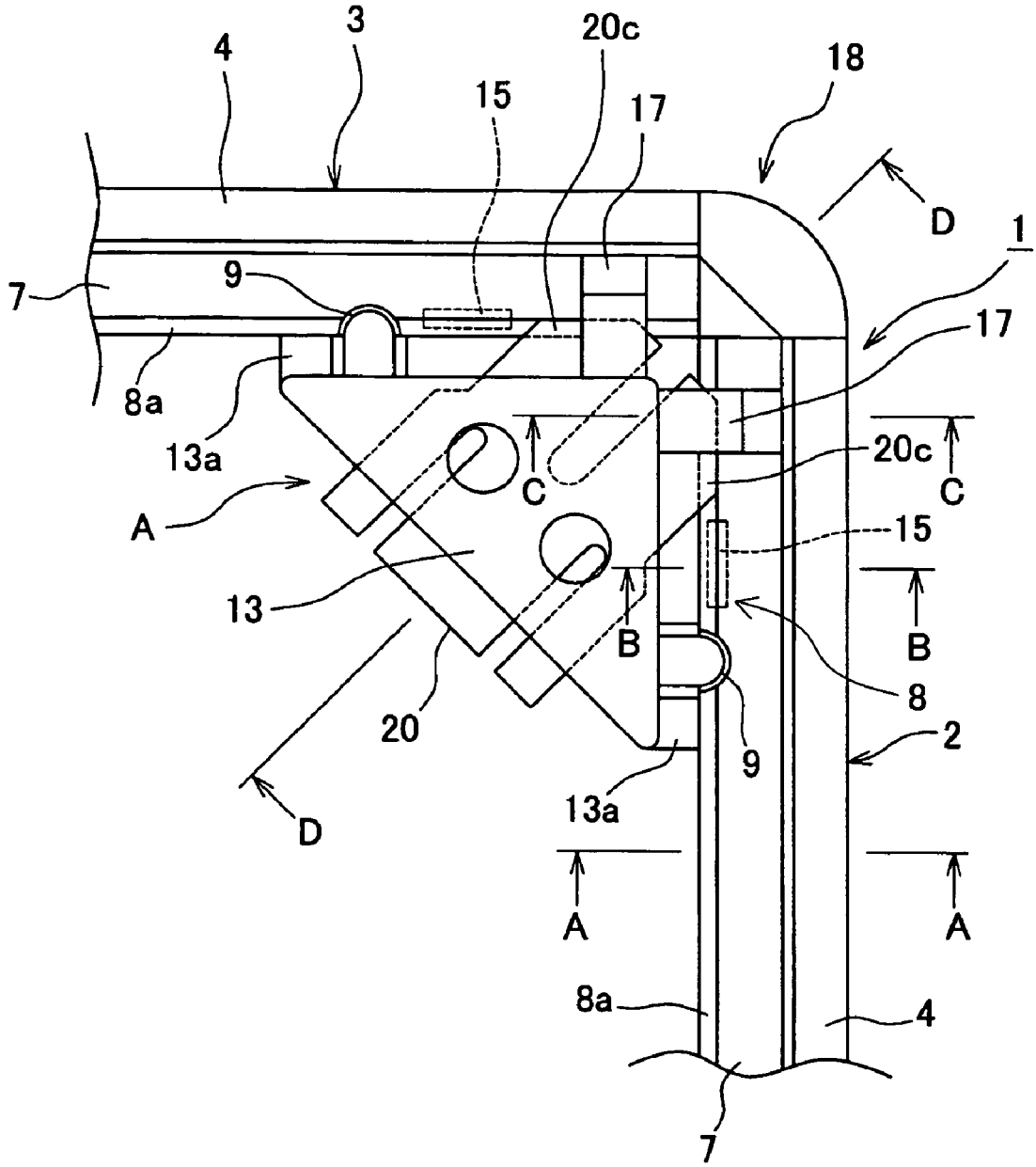
FIG. 2 is an enlarged plan view of a part of the connecting device for the frame members.
Figure 3:
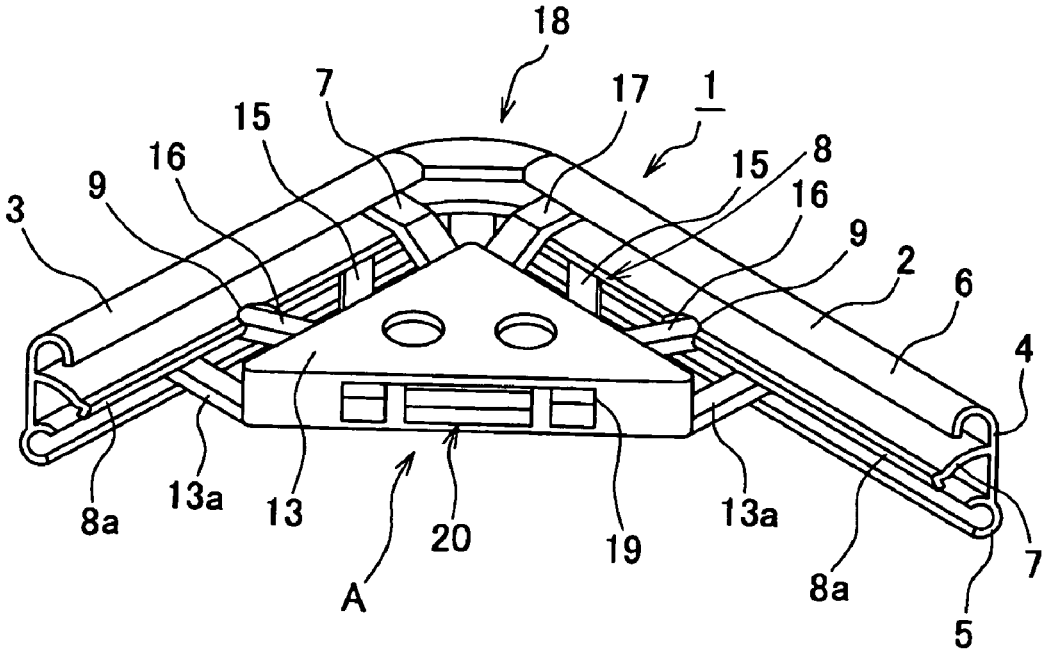
FIG. 3 is a perspective view of FIG. 2.

FIG. 1 shows a perspective view of the entire frame, in which a reference numeral 1 denotes a frame such as a picture frame, a poster frame, a jigsaw puzzle frame, and so on. The frame 1 is formed in a planar rectangular shape by connecting a pair of long frame members 2, 2 and a pair of short frame members 3, 3, the frame members of each pair having the same length, through use of four connecting devices A, A . . . . Incidentally, considerable planar shapes of the frame 1 include, not limited to the rectangular shape, other polygonal shapes such as a square shape, a triangular shape, and so on.

Figure 6:
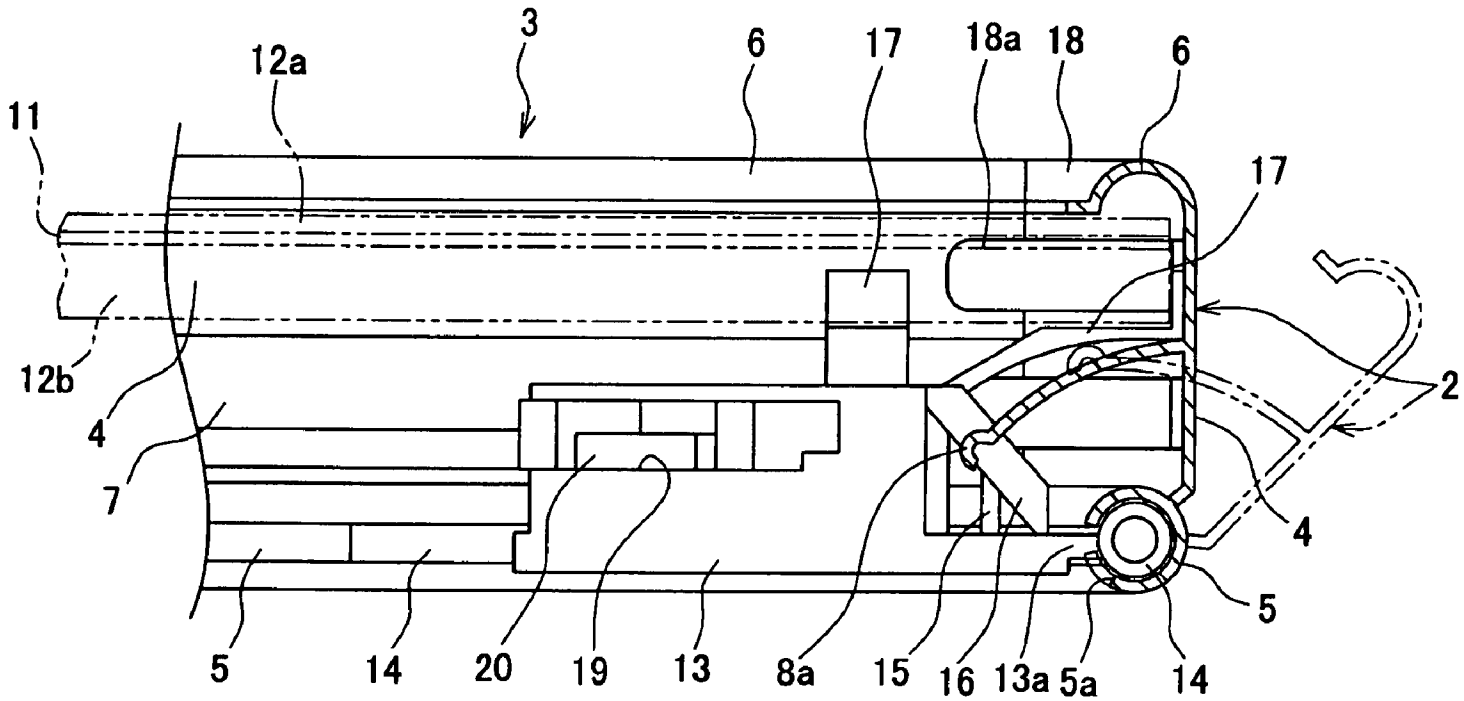
FIG. 6 is a cross-sectional view taken along an A-A line in FIG. 2.
Figure 7:
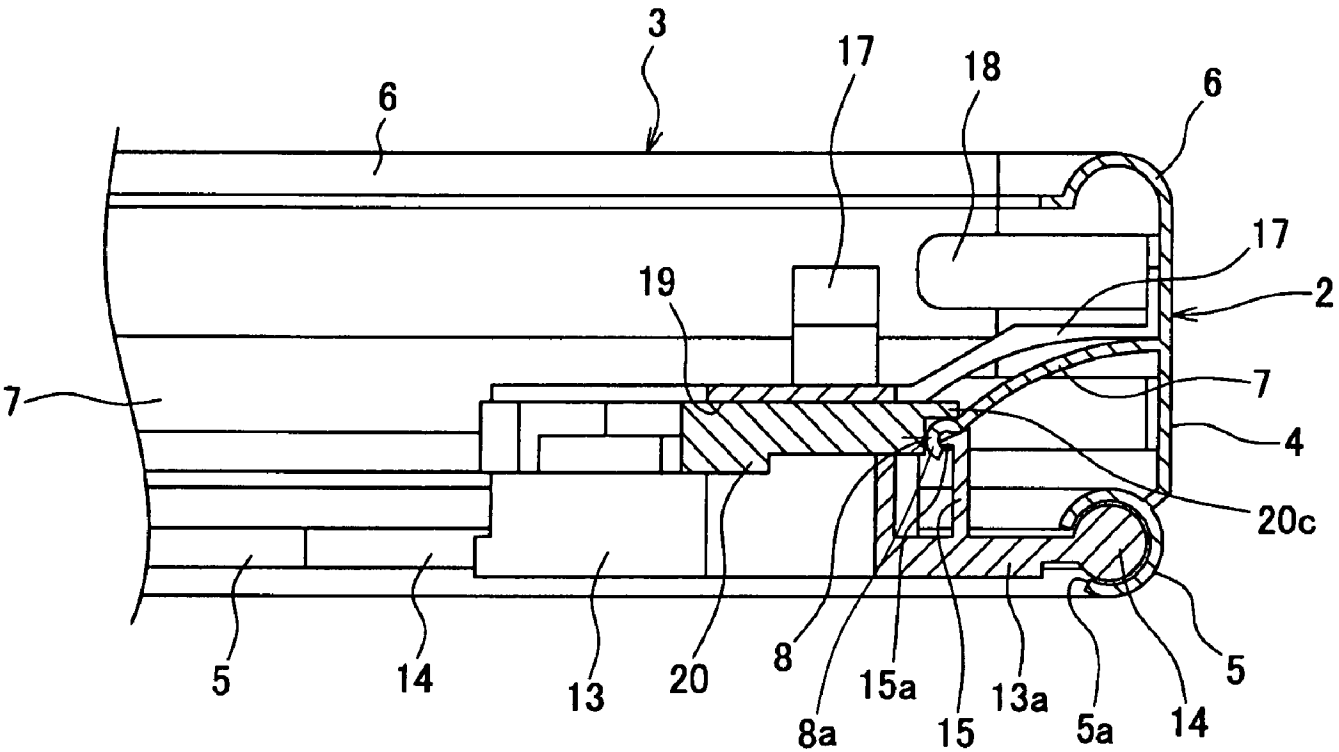
FIG. 7 is a cross-sectional view taken along a B-B line in FIG. 2.
Figure 8:
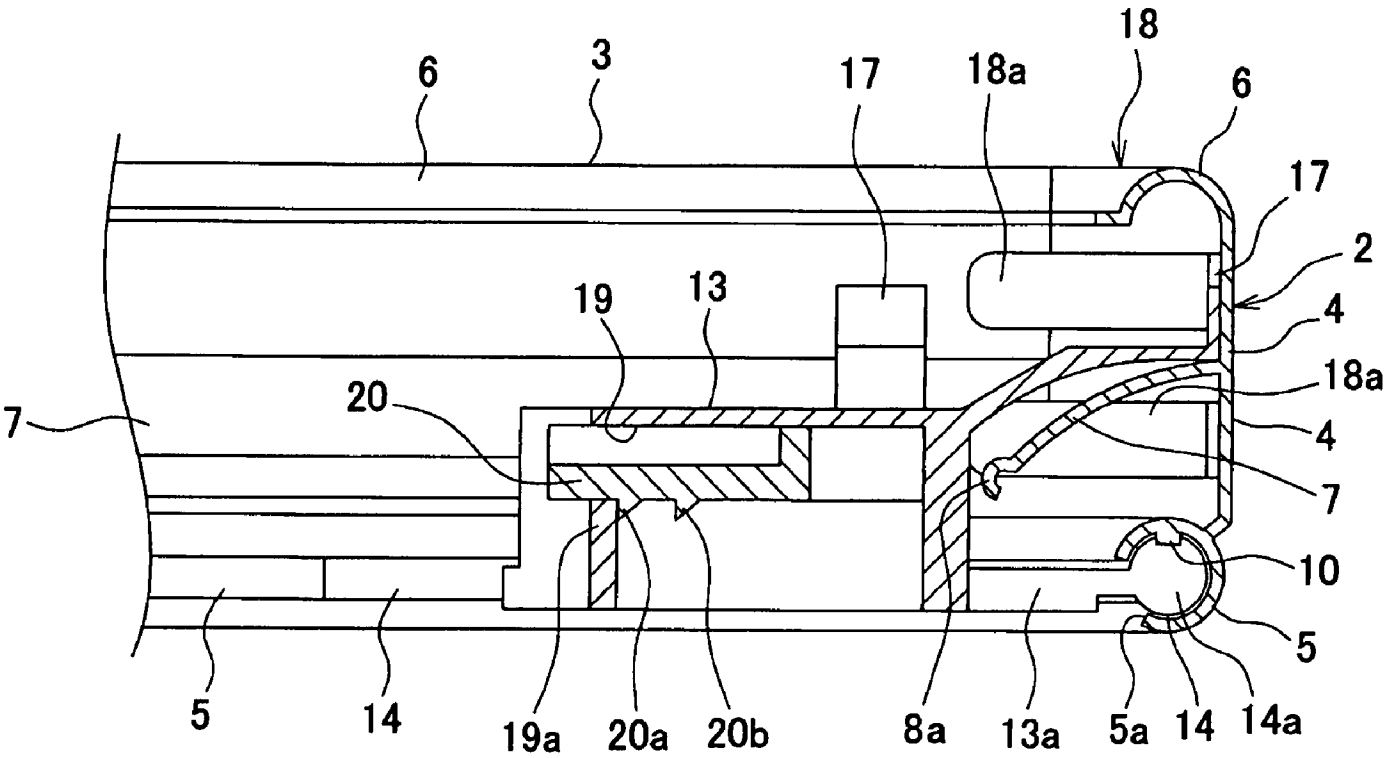
FIG. 8 is a cross-sectional view taken along a C-C line in FIG. 2.

The frame member 2 or 3 is preferably made of aluminum and constituted of, as shown in FIG. 6 to FIG. 8 in particular, a base material portion 4; a pivotal attachment recess 5 located at the lower part of the base material portion 4; a showpiece arresting portion 6 provided at the upper part of the base material portion 4 in a manner to be curved inward; and a partition 7, located between the showpiece arresting portion 6 and the pivotal attachment recess 5, provided in a manner to be curved inwardly downward from the base material portion 4. The partition 7 is provided with a first engaging projection 8*a* and an engaging notch 9 near its end portion. Further, a small second engaging projection 10 (illustrated in FIG. 8) is provided which is located at the end portion of the pivotal attachment recess 5 and engages with a notch provided in a later-described hinge shaft portion.

The connecting device A in this embodiment is constituted of a base 13 on which a corner portion of a showpiece 11 is mounted together with a retaining plate 12*a* and a transparent plate 12*b* shown by imaginary lines in FIG. 6 in particular; a pair of hinge shaft portions 14, 14 provided in directions perpendicular to each other on both sides of the base 13; first engaging protruding pieces 15, 15 which are provided proximate to the hinge shaft portions 14, 14 and provided with projections 15*a*, 15*a* at their tips engaging with the first engaging projections 8*a*, 8*a* provided inside the partitions 7, 7 when the frame members 2, 2 and 3, 3 are closed as shown in FIG. 7 in particular, second engaging protruding pieces 16, 16 which are similarly provided proximate to the hinge shaft portions 14, 14 and on the side on which the first engaging protruding pieces 15, 15 are provided and engage with the engaging notches 9, 9 provided in the partitions 7, 7 when the frame members 2, 2 and 3, 3 are closed to prevent movement of the frame members 2, 2 and 3, 3 in longitudinal directions; stopper pieces 17, 17 which butt against the inside of the base material portions 4 when the frame members 2, 2 and 3, 3 are closed as shown in FIG. 7 and FIG. 8 in particular; a corner member 18 swingably attached to the tip of the base 13; and a plate-shape locking means 20 slidably accommodated in an accommodating hole 19 provided inside the base 13. The connecting device, however, is not limited to the above-described one as will be described later. The projection 15*a* of the first engaging protruding piece 15 and the first engaging projection 8*a* provided on the partition 7 constitute a mechanical arresting means 8.

Figure 4:
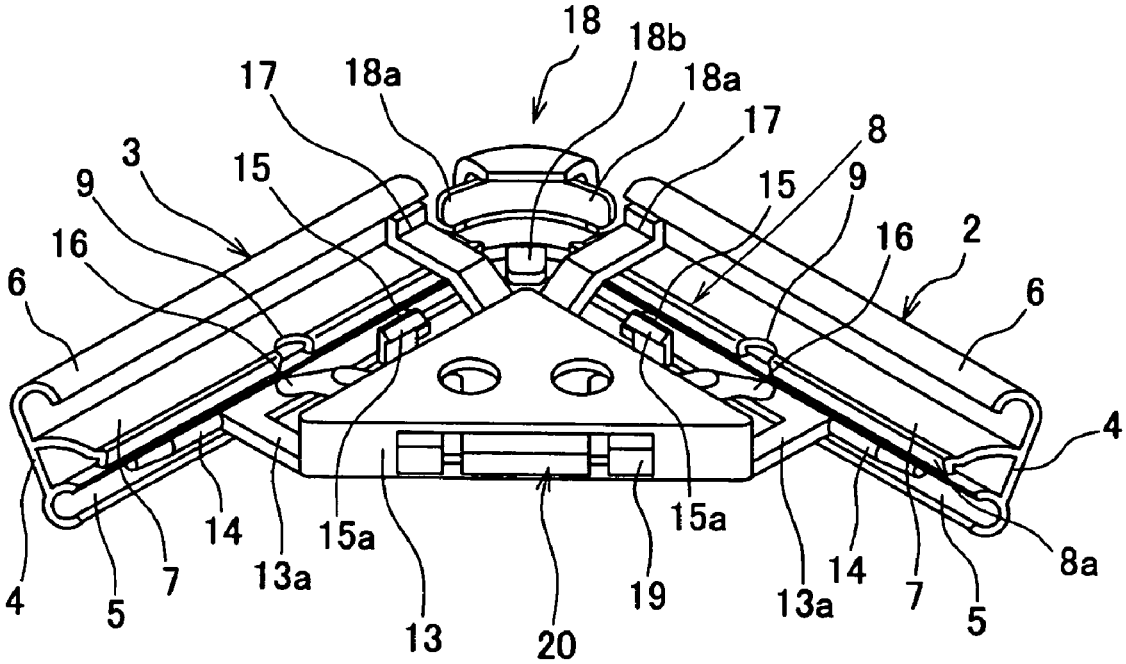
FIG. 4 is a perspective view of the frame members as seen when they are opened outward from the state shown in FIG. 3.
Figure 5:
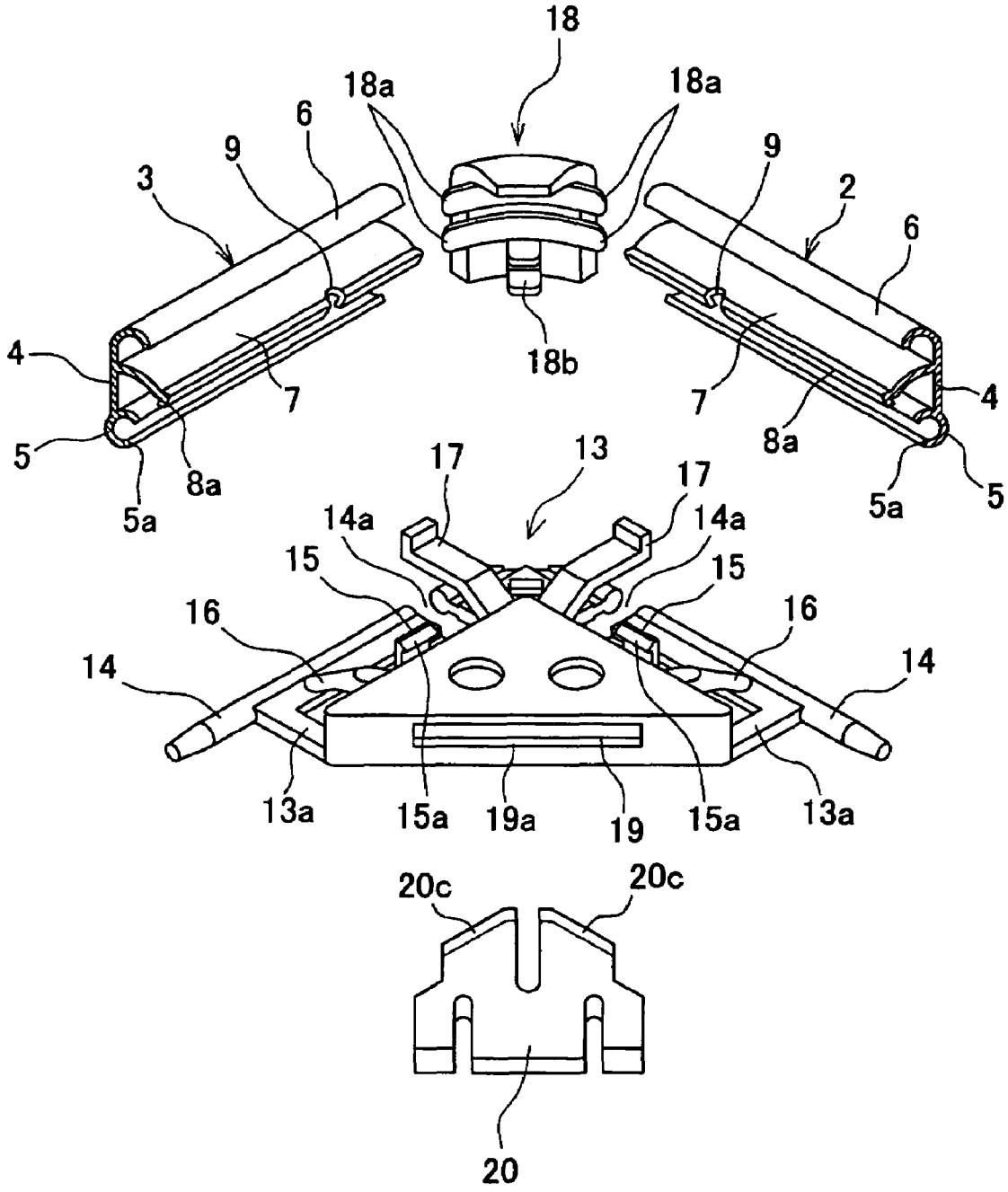
FIG. 5 is an exploded perspective view of the connecting device for the frame members according to the present invention.
Figure 9:
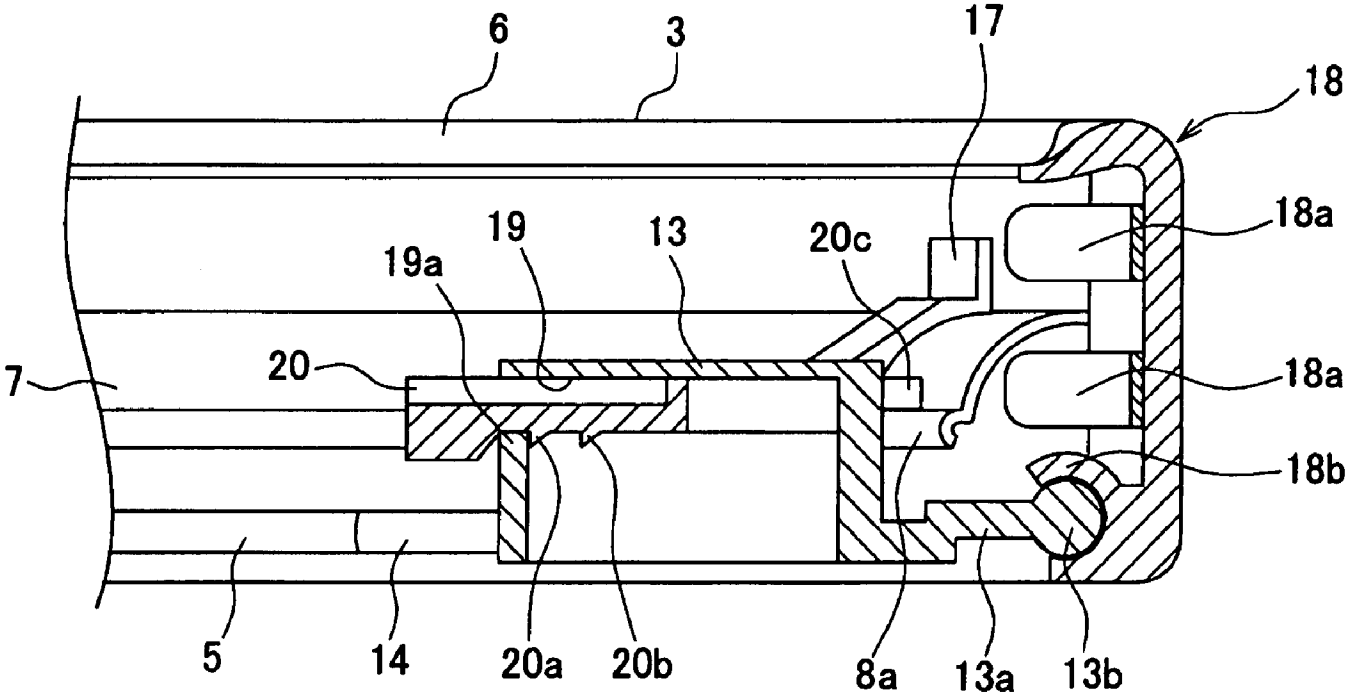
FIG. 9 is a longitudinal sectional view of a locking means before releasing lock as seen from a D-D line direction in FIG. 2.
Figure 10:
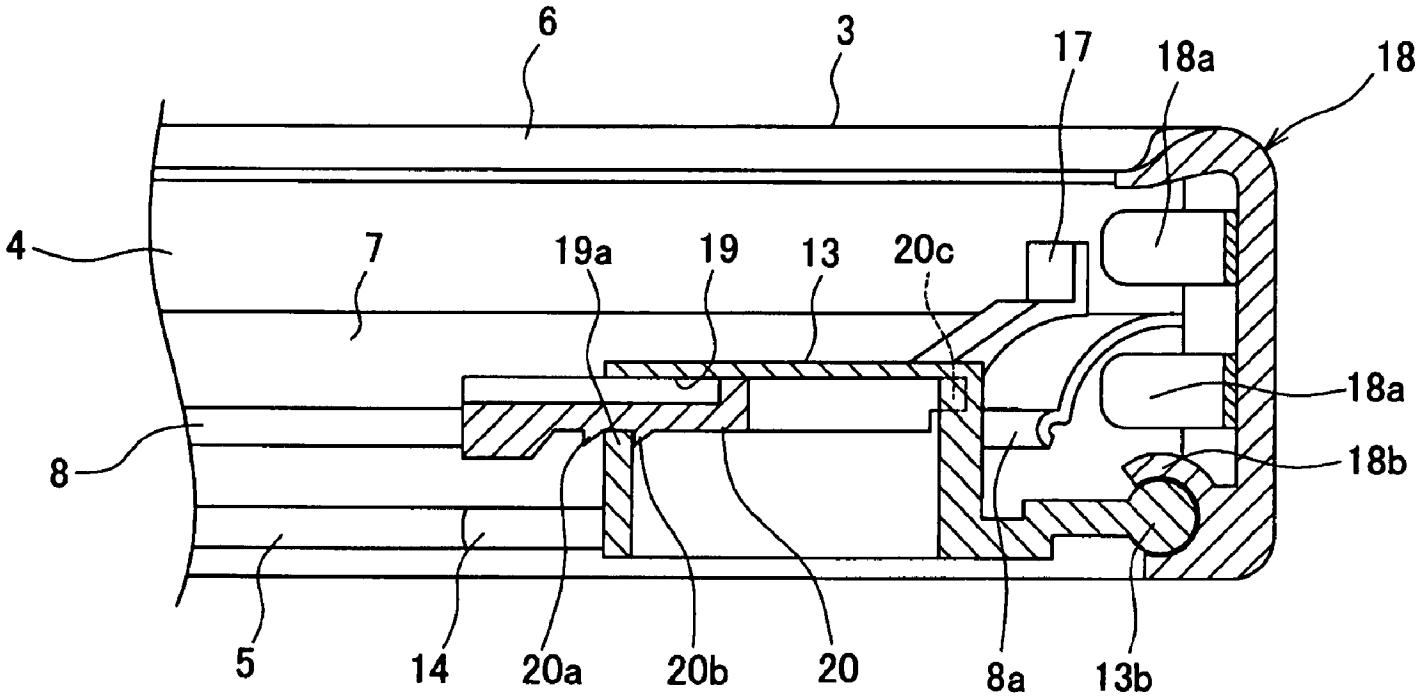
FIG. 10 is a longitudinal sectional view of a locking means after releasing lick, corresponding to FIG. 9.
Figure 11:
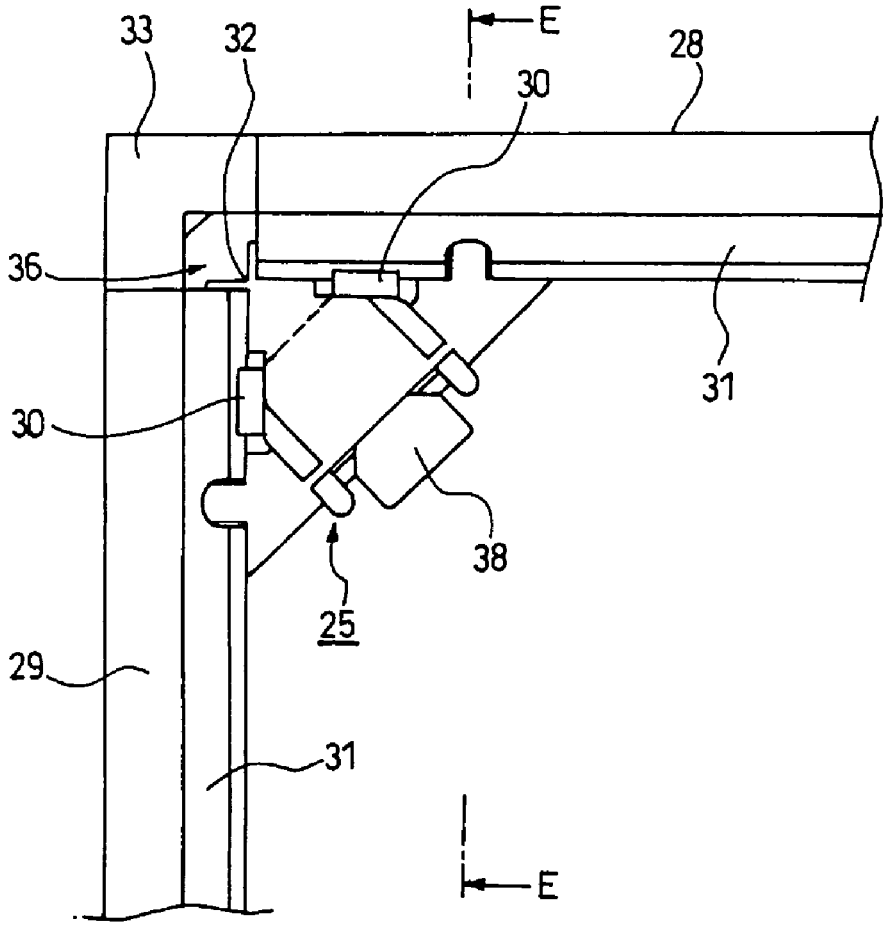
FIG. 11 is a plan view showing another embodiment of the connecting device for the frame members according to the present invention.
Figure 12:
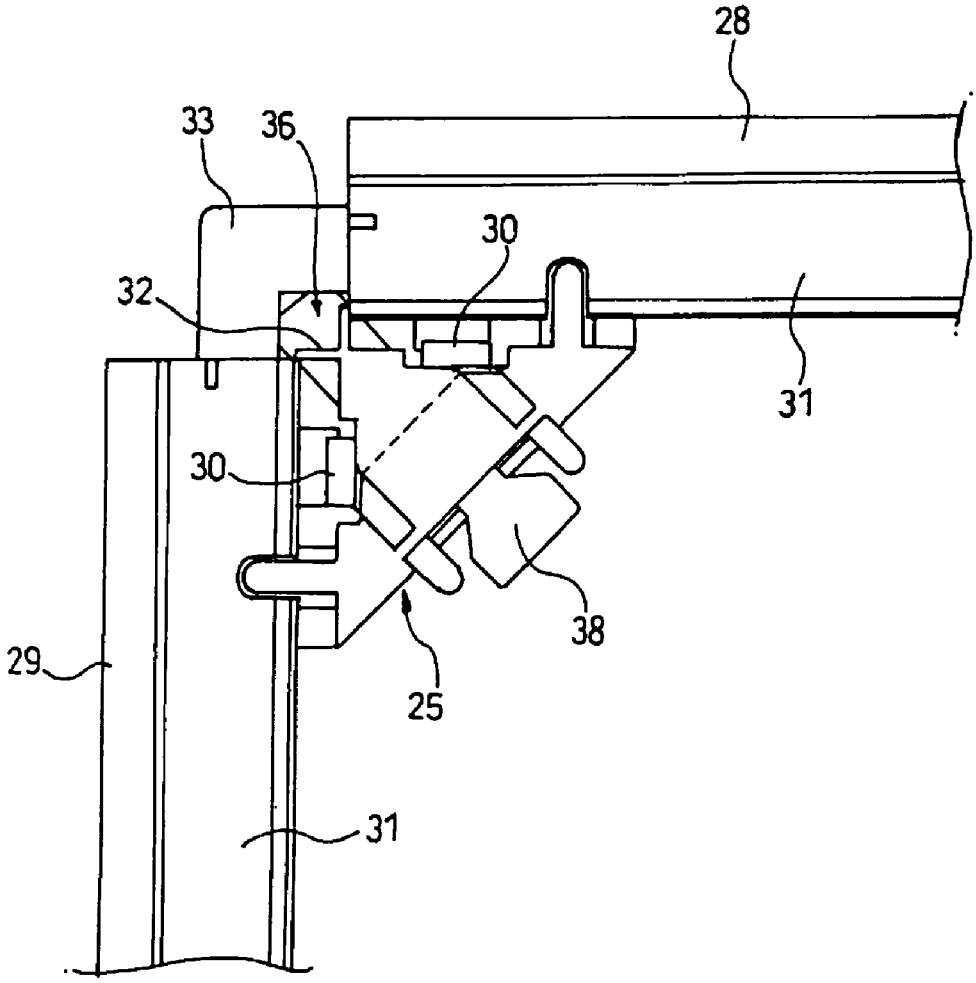
FIG. 12 is a plan view of the frame members as seen when they are opened, from a base, from the state shown in FIG. 11.
Figure 13:
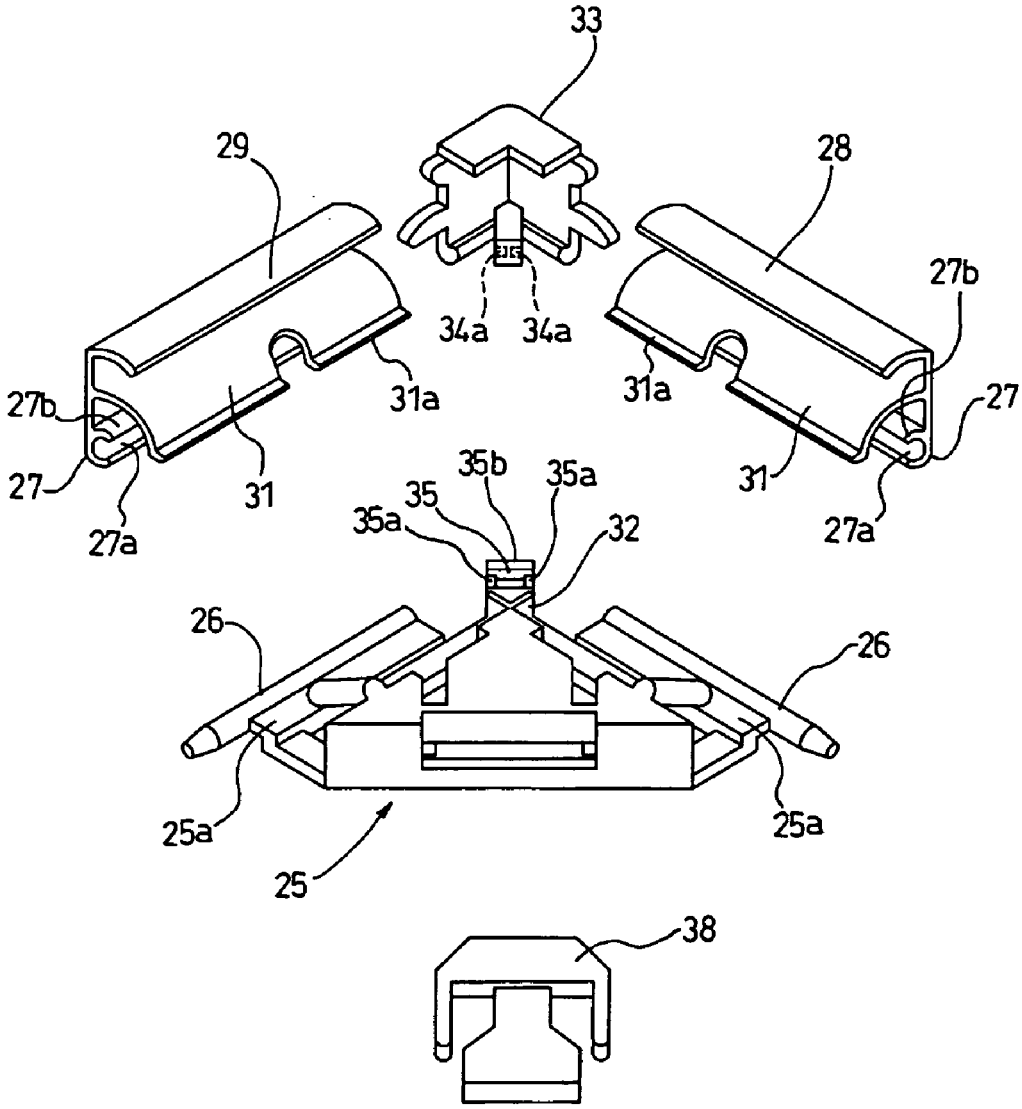
FIG. 13 is an exploded perspective view of the connecting device for the frame members shown in FIG. 11.

The corner member 18 has a plurality of arresting protruding pieces 18*a*, 18*a* . . . engaging with the end portions of the frame members 2, 2 and 3, 3, provided on its both sides, that is, on the right and left sides as seen from a plane, and is capable of swinging back and forth by engaging an engaging recess 18*b* provided at it lower part with an engaging shaft portion 13*b* provided on the base 13 as shown in FIG. 9 and FIG. 10 in particular. Accordingly, the corner member 18 is configured to open by its own weight when the frame members 2 and 3 are opened to release the arresting effect by the end portions of the frame members 2 and 3 to the arresting protruding pieces 18*a*, 18*a* . . . as shown in FIG. 4, and to be closed together with and by the end portions of the frame members 2 and 3 when the frame members 2 and 3 are closed. The corner member, however, is not limited to one having the above configuration, as will be described later.

It should be noted that the corner member 18 in this embodiment is devised such that the engaging recess 18*b* is shifted forward by devising the set position of the engaging recess 18*b* as shown in FIG. 9 and FIG. 10 in particular, whereby when the engagement of the arresting protruding pieces 18*a*, 18*a* by the frame members 2 and 3 is released, the corner member 18 automatically opens because the barycenter (the center of mass) of the corner member 18 is located rearward, but the corner member 18 is not limited to one having the above configuration. The corner member 18 may be manually closed or may employ a separate elastic means such as a leaf spring, a spring, or the like.

The locking means 20 in this embodiment is like a plate having a planar substantially arrow shape provided with a pair of first arresting projection 20*a* and second arresting projection 20*b* on one side on its lower face, and configured to alternately arrest the first and second arresting projections 20*a*, 20*b* to an engaging portion 19*a* formed in the accommodating hole 19 provided in the base 13 so as to keep a lock position when moving forward into the accommodating hole 19 and a release position when moving backward from the accommodating hole 19 as shown in FIG. 2 and 5 and FIG. 9 and FIG. 10 in particular.

As shown in FIG. 9 in particular, when the locking means 20 moves forward, locking portions 20*c*, 20*c* provided at tips of the arrow shape are engaged with the upper side of the first engaging projections 8*a* of the frame members 2 and 3 to thereby prevent the frame members 2 and 3 from opening. As shown in FIG. 10, when the locking means 20 moves backward, the engaging state between the locking portions 20*c*, 20*c* and the upper side of the first engaging projections 8*a* of the frame members 2 and 3 is released to thereby allow the frame members 2 and 3 to open.

Note that the configuration of the plate-like locking means 20 is not limited to one sliding back and forth as in this embodiment, but may be replaced with a rotating one in which a part of the partition 7 of each of the frame members 2, 2 and 3, 3 is arrested by another part.

Accordingly, in a state in which the frame members 2, 2 and 3, 3 and the corner member 18 are opened outward as shown in FIG. 4 and the showpiece 11 is mounted on the stopper pieces 17 of the base 13 of the connecting device A together with the retaining plate 12*a* and the transparent plate 12*b* as shown in FIG. 6 in particular, when the frame members 2, 2 and 3, 3 are rotated inward, the frame members 2, 2 and 3, 3 are closed inward to the connection positions with respect to the base 13 of the connecting device A, that is, pivot with, as fulcrums, the hinge shaft portions 14 with which the pivotal attachment recesses 5 engages, so that the first engaging projections 8*a* provided on the tips of the partitions 7 engage with the projections 15*a* of the first engaging protruding pieces 15 erected on the base 13. Note that the projections 15*a* may be provided in a direction opposite to that of this embodiment. Then, the frame members 2, 2 and 3, 3 try to close inward by spring retained by the first arresting protruding pieces 15, but the stopper pieces 17 butt against the inside of the base material portions 4 of the frame members 2, 2 and. 3, 3 at that time as shown in FIG. 8 in particular, whereby the frame members 2, 2 and 3, 3 stop at that position. In other words, the stopper piece 17 constitutes a closing stop means. Note that this closing stop means need not be composed of the stopper piece 17 but may be replaced with the mechanical arresting means 8 composed of the first engaging projection 8*a* provided on the inside of the tip of the partition 7 and the first engaging protruding piece 15 erected on the base 13 and having the projection 15*a*. Further, there is no limitation on the configuration of the closing stop means, which may be implemented by a part of the partition 7 butting against a part of the base 13 or by the upper edge side of the pivotal attachment recess 5 butting against the part of the base 13.

Further, although the showpiece 11 or the like is mounted on the stopper pieces 17 in the embodiment shown in FIG. 6, the showpiece 11 may be mounted on the base 13 when the stopper pieces 17 are replaced with other means.

In the manner described above, the frame members 2, 2 and 3, 3 are kept in the closed state. In this event, the corner member 18 having their engaging protruding pieces 18*a* arrested to the end portions of the frame members 2, 2 and 3, 3 is also turned and closed inward together with closing actions of the frame members 2, 2 and 3, 3. Consequently, the showpiece 11 is thus fixedly placed on the frame 1.

When the frame members 2, 2 and 3, 3 are closed inward, the engaging notches 9 provided in the frame members 2, 2 and 3, 3 engage with the second engaging protruding pieces 16, 16 provided on the base 13 to prevent the frame members 2, 2 and 3, 3 from moving in the respective axial directions. This prevents deformation or separation of the frame 1 due to the weight of the showpiece 11, the retaining plate 12*a*, the transparent plate 12*b*, or the like when the frame 1 is hung on a wall or the like for exhibition.

Then, when the locking means 20 at a first waiting position is pushed to engage the locking portions 20*c*, 20*c* provided at tips thereof with the upper side of the first engaging projections 8*a* provided at tips of the partitions 7 of the frame members 2, 2 and 3, 3 as shown in FIG. 9, the first arresting projection 20*a* is locked to the engaging portion 19*a* in the accommodating hole 19 to prevent the locking means 20 from moving, whereby the frame members 2, 2 and 3, 3 are locked closed inward not to open outward.

When replacing the showpiece 11 with another from this state, an end portion of each of the locking means 20 on the side exposed from the accommodating hole 19 is first pushed in a top-bottom direction to release the engagement between the first arresting projection 20*a* and the engaging portion 19*a* provided in the accommodating hole 19, and then the exposed side end portion is grasped and drawn inward, whereby the engagement of the locking portions 20*c*, 20*c* with the upper side of the first engaging projections 8*a* provided on the partitions 7 provided on the frame members 2, 2 and 3, 3 is released and at the same time the second arresting projection 20*b* engages with the engaging portion 19*a*. Then, a finger is placed on and turns outward a part of each of the showpiece arresting portions 6 of the frame members 2, 2 and 3, 3, whereby the engagement between the first engaging projections 8*a* provided on the partitions 7 and the first engaging protruding pieces 15 provided on the sides of base 13 side is released, so that the frame members 2, 2 and 3, 3 are opened outward. At the same time, the corner member 18 released from its engagement with the end portions of the frame members 2, 2 and 3, 3 opens outward by its own weight. Note that it has already been described that the corner member 18 may be pushed outward by a finger to open.

Each of the opened frame members 2, 2 and 3, 3 can be stopped to form a predetermined open angle, that is, an open angle of 45° in this embodiment as shown in FIG. 6 by one open end edge 5*a* of the pivotal attachment recess 5 of the base material portion 4 butting against an extended portion 13*a* provided with a hinge shaft portion 14*a*.

Accordingly, the open end edge 5*a* of the pivotal attachment recess 5 and the extended portion 13*a* constitute an opening stop means, which is not limited to this configuration and may be replaced with a stopper means having other configurations.

In the corner member 18 which has opened by its own weights, a first stopper means 21 stopping at a predetermined open angle is also constituted by its arresting protruding pieces 18*a* being arrested to the end portions of the opened frame members 2, 2 and 3, 3. Note that, as for this part, a second stopper means 22 may be constituted by an abutting portion 18*c* provided at the open end of the engaging recess 18*b* butting against the extended portion 13*a* as shown in FIG. 9 and FIG. 10.

Then, when the showpiece 11 is replaced with another and the frame members 2, 2 and 3, 3 are rotated inward as described above, the other showpiece 11 is set in the frame 1, whereby setting and replacement of the showpiece 11 can be implemented.

Second Embodiment

Figure 14:
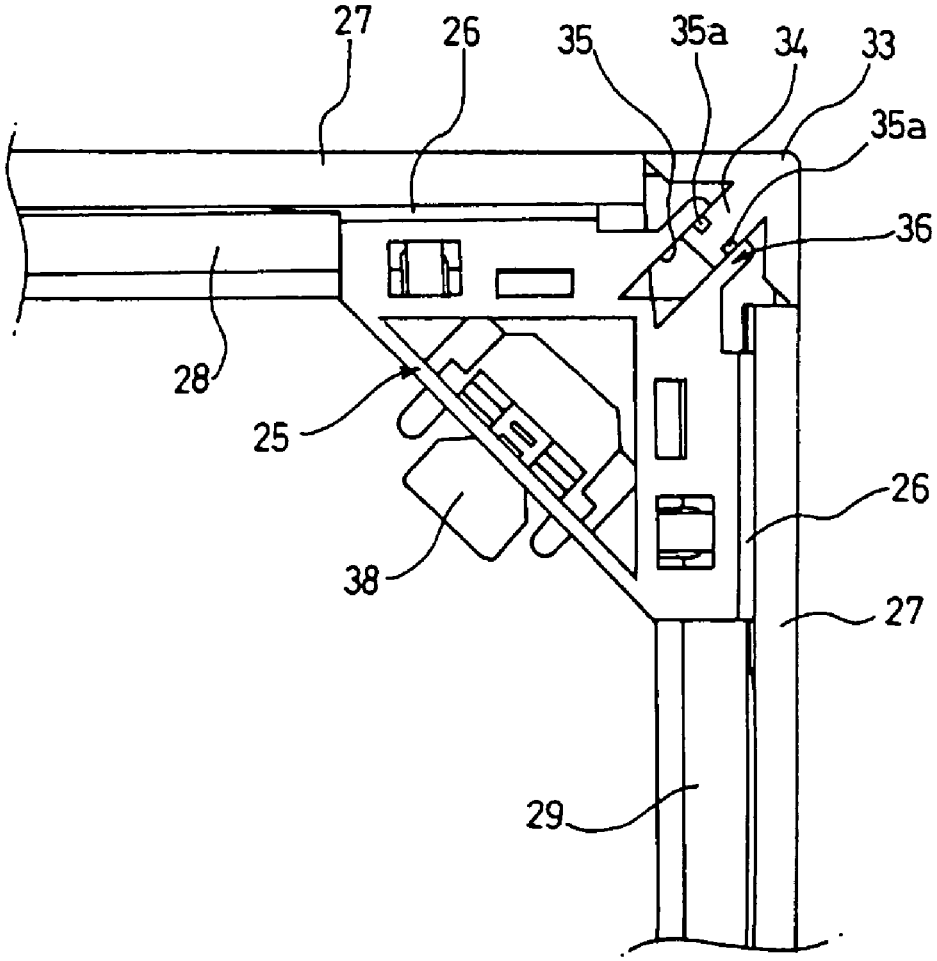
FIG. 14 is a bottom view of the connecting device for the frame members shown in FIG. 11.
Figure 15:
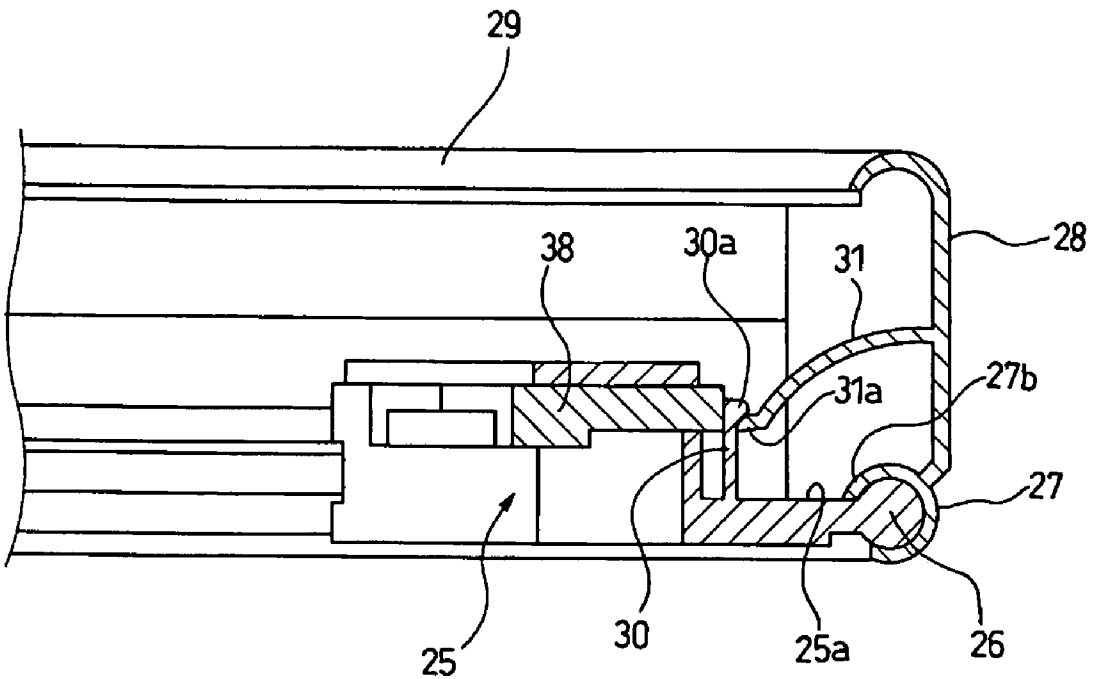
FIG. 15 is an enlarged cross-sectional view taken along an E-E line in FIG. 11.

FIG. 11 to FIG. 15 show another embodiment. With reference to the drawings, the stopper members 17, 17 shown in the first embodiment described above are omitted in a base 25 according to this embodiment. Even through the stopper members 17, 17 shown in the preceding embodiment are omitted, an upper side 27*b* of an open portion 27*a* of a pivotal attachment recess 27 pivotally attached to a hinge shaft portion 26 butts from the upper side against an extended portion 25*a* which is extended from the base 25 and provided with the hinge shaft portion 26 is provided as shown in FIG. 15 in particular, whereby long and short frame members 28, 29 closed can be stopped at right positions.

Further, in the second embodiment, a first engaging protruding piece 30 is provided to be located outside an engaging portion 31*a* on the free end side of a partition 31 as shown in FIG. 15 in particular, and a projection 30*a* provided to arrest the engaging portion 31*a* of the partition 31 to the first engaging protruding piece 30 protrudes to the partition 31 side.

Further, in the second embodiment, an abutting portion 32 is provided at a position where end portions of the long and short frame members 28, 29 attached to the base 25 intersect with each other at right angles on the base 25.

The above configuration fixes the attachment positions of the long and short frame members 28, 29 to the base 25, thereby providing an advantage of reducing as much as possible the possibility of inhibiting formation of a right rectangular shape of the frame due to occurrence of a gap between the frame members and a corner member 33 or digging of the end portions of the frame members 28, 29 into the corner member 33.

Further, the corner member 33 is desirably made of synthetic resin and devised such that its corner portion is subjected to chamfering to be smoothed, thereby preventing a hand from being hurt. In addition, the corner member 33 is pivotally attached to the base 25 to be swingable, as shown in FIG. 14 in particular, by means of a hinge mechanism 36 constituted by fitting a connecting protruding piece 34 of the corner member 33 into a connecting groove portion 35 provided on the base 25 side so as to fit shaft support holes 34*a*, 34*a* provided on both sides of its tip on projections 35*a*, 35*a* provided on the connecting groove portion 35. Note that a stopper means 37 for stopping the open state of the corner member 33 at a predetermined open angle is constituted of a part of the connecting protruding piece 34 and an abutting portion 35*b* provide on the connecting groove portion 35 against which the part of the connecting protruding piece 34 butts. Other members are the same as those in the first embodiment except that their shapes are different. Note that a reference numeral 38 denotes a locking means.

Third Embodiment

Figure 16:
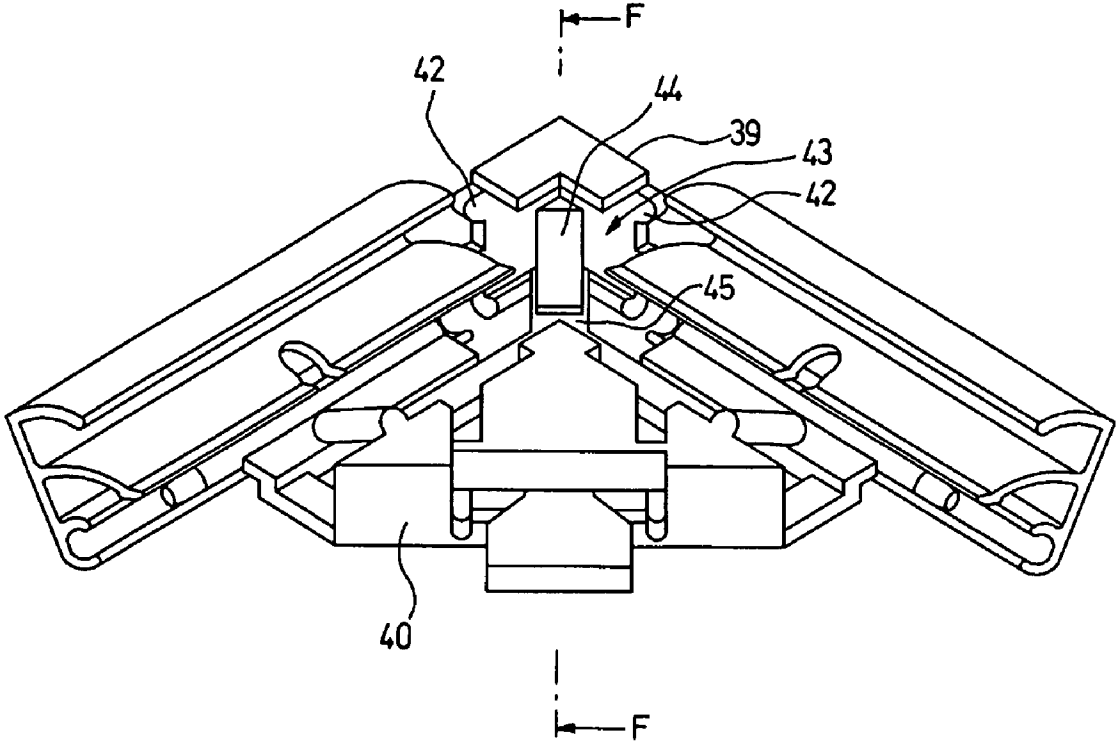
FIG. 16 is a developed perspective view showing still another embodiment of the connecting device for the frame members according to the present invention.
Figure 17:
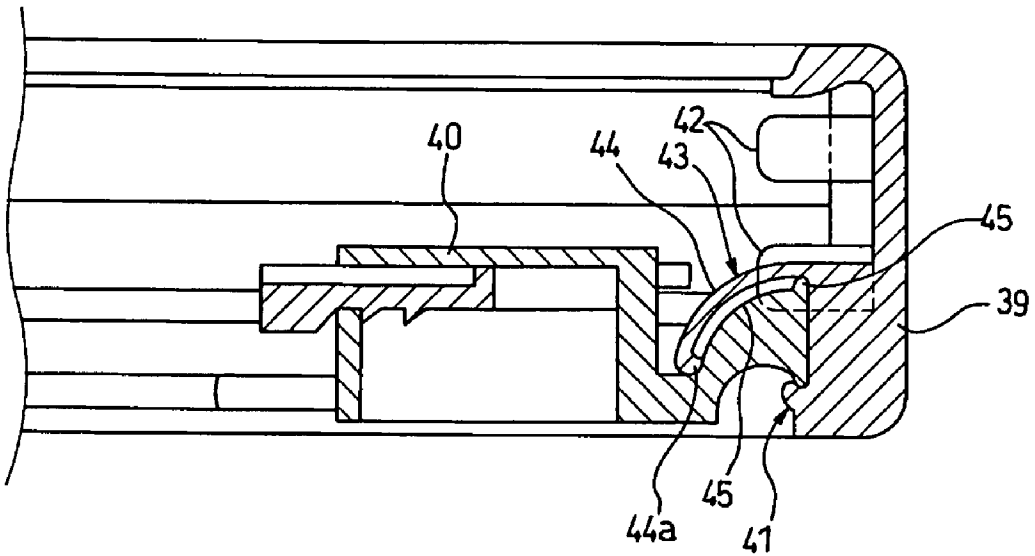
FIG. 17 is an enlarged cross-sectional view taken along an F-F line in FIG. 16.
Figure 18:
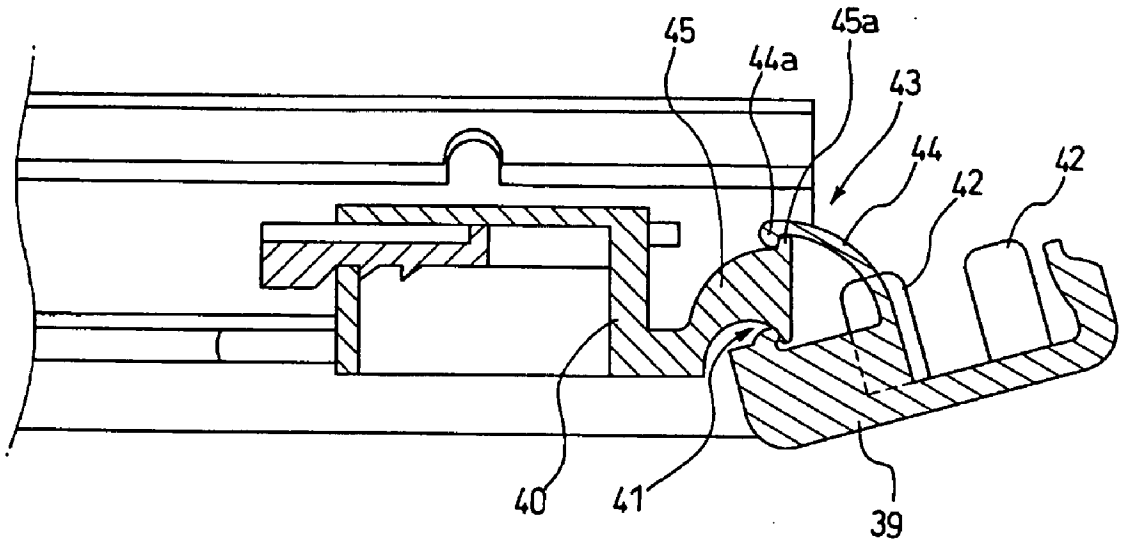
FIG. 18 is an explanatory view for explaining an operation of a corner member of the connecting device for the frame members shown in FIG. 16.
Figure 19:
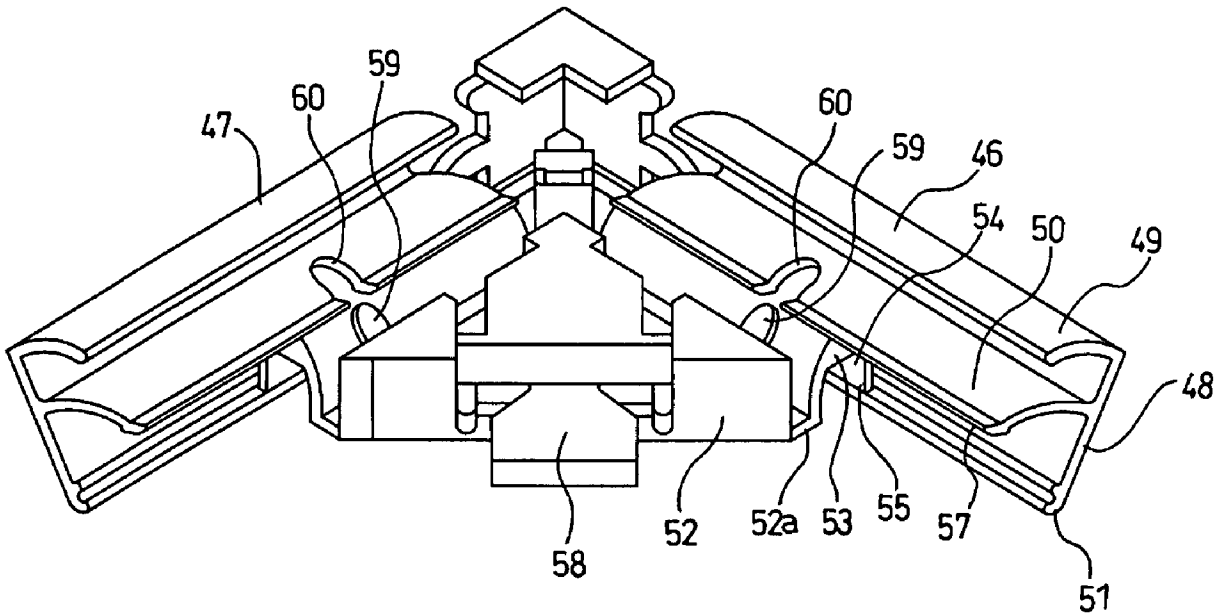
FIG. 19 is a developed perspective view showing yet another embodiment of the connecting device for the frame members according to the present invention.
Figure 20:
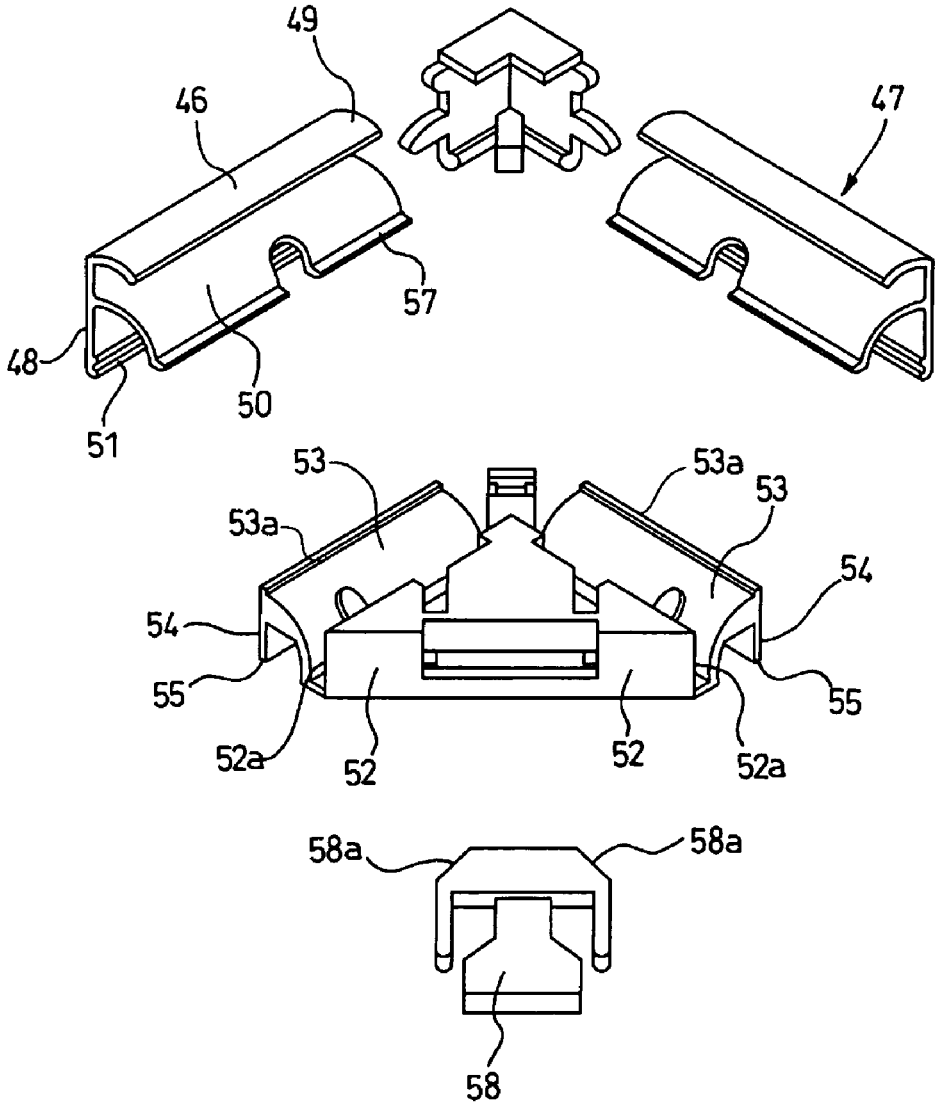
FIG. 20 is an exploded perspective view of the connecting device for the frame members shown in FIG. 19.

FIG. 16 to FIG. 18 show still another embodiment of the connecting device according to the present invention. In this third embodiment, a hinge mechanism 41 for connecting a corner member 39, which is similarly desirably made of synthetic resin and whose corner portion is subjected to chamfering to be smoothed, to a base 40 and a first stopper means 42 are not sufficiently illustrated but are the same as those in the second embodiment. An opening stop means 43 of the corner member 39 is constituted of an engaging tongue piece 44 provided to protrude from the corner member 39 and provided with an engaging portion 44*a* at its free end side and an engagement guide portion 45 provided to protrude toward the base 40 side and provided with a protrusion 45*a* on its upper portion for arresting the engaging portion 44*a* of the engaging tongue piece 44 thereto.

The above configuration allows the corner member 39 to stop at a predetermined open position when it is opened, by engagement of the engaging portion 44*a* of the engaging tongue piece 44 with the protrusion 45*a* of the engagement guide portion 45.

Fourth Embodiment

FIG. 19 to FIG. 22 show yet another embodiment of the connecting device according to the present invention. With reference to the drawings, to explain the configuration of long and short frame members 46, 47 by using only on of them, the frame member 46, the frame member 46 has, similarly to that in the preceding first to third embodiments, a base material portion 48; a showpiece arresting portion 49 provided to be curved from the upper end of the base material portion 48; and a partition 50 located below the showpiece arresting portion 49 and provided to extend from the base material portion 48 in the same direction as that of the showpiece arresting portion 49. The cross-sectional shape of a pivotal attachment recess 51 is not in the shape to wrap around the hinge shaft portion 14 for prevention of free-fall as in the first embodiment but in the shape of a shallow recess for just arresting it.

Further, a portion of a base 52 to which the frame member 46 is attached is constituted of a pivot guide portion 53 erected from an extended portion 52*a* with its outer peripheral face formed in an arc shape; and a side face portion 54 sagging downward from the free end of the pivot guide portion 53, and an engaging end 55 which engages with the above-described pivotal attachment recess 51 is provided at the lower end portion of the side face portion 54.

Figure 21:
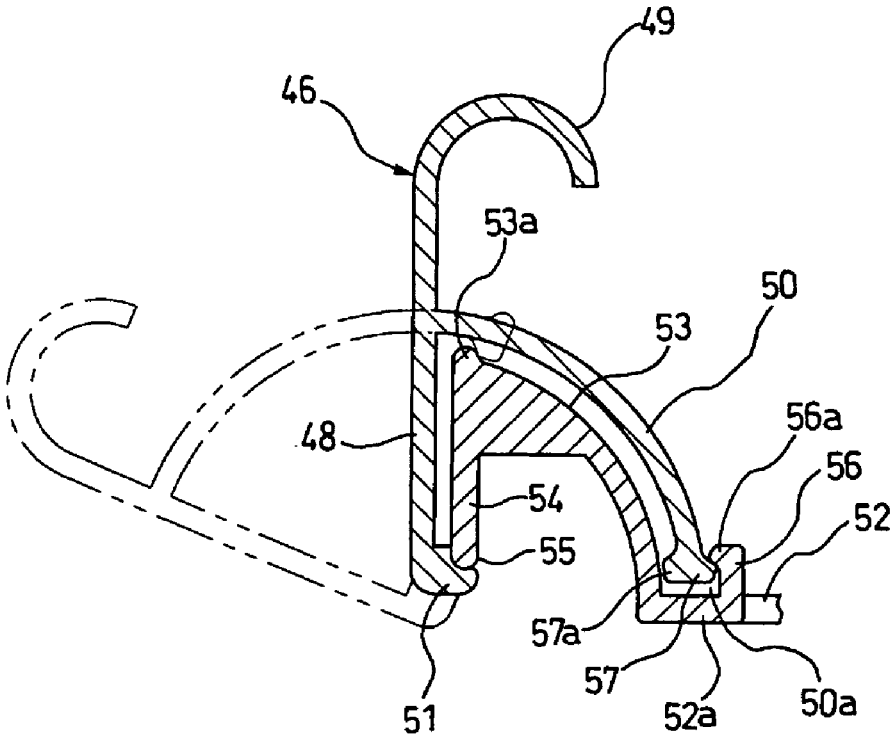
FIG. 21 is an explanatory view for explaining an operation of the connecting device for the frame members shown in FIG. 19.
Figure 22:
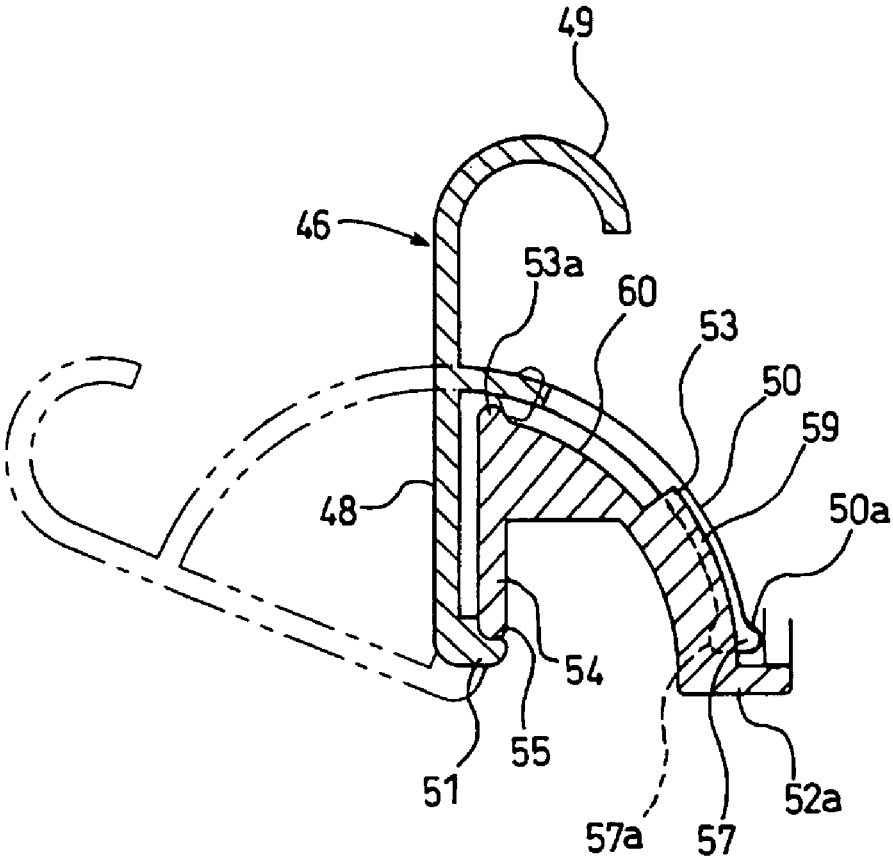
FIG. 22 is a similar explanatory view for explaining an operation of the connecting device for the frame members shown in FIG. 19.

Further, as shown in FIG. 21 and FIG. 22 in particular, a first engaging protruding portion 57, which engages with a first engaging protruding piece 56 erected from the extended portion 52*a* on the base 52 side and having a protruding portion 56*a* at a tip, is provided outside the free end side of the partition 50. In addition, an engaging protruding portion 57*a*, which engages with an engaging projection 53*a* provided at the upper end portion of the pivot guide portion 53, is provided inside the first engaging protruding portion 57.

Accordingly, the pivotal attachment recesses 51 engage with the engaging ends 55 of the side face portions 54 of the base 52, and the partitions 50 engage with the pivot guide portions 53, whereby the frame members 46, 47 according to this fourth embodiment are attached to the base 52 without free-fall. The pivotal attachment recesses 51 and the engaging ends 55 engage with each other, and the first engaging protruding portions 57 of the partitions 50 engage with the first engaging protruding pieces 56 in the closed state of the frame members 46, 47.

This closed state is kept stable because locking portions 58*a* of locking means 58 retain the first engaging protruding pieces 56 so that the first engaging protruding pieces 56 do not swing to escape due to a force applied in directions of opening the frame members 46, 47.

When one tries to open the frame members 46, 47 from this closed state, he or she moves the locking means 58 backward, and applies a force outward to the frame members 46, 47. Then, the engagement between the first engaging protruding pieces 56 and the first engaging portions 57 is released, and the partitions 50 are guided by the pivot guide portions 53, while the pivotal attachment recesses 51 of the frame members 46, 47 engage with the engaging ends 55 of the base 52, and their engaging portions 50*a* engage with the engaging projections 57*a* to stop the frame members 46, 47. The frame members 46, 47 can be opened in the above-described manner.

When the frame members 46, 47 are closed again, they are closed with the engaging ends 55 as fulcrums into a closed state by the first engaging protruding portions 57 engaging with the projections 56*a* of the first engaging protruding pieces 56. By pushing the engaging means 58, its locking portions 58*a*, 58*a* butt against the first engaging protruding piece 56, 56 to lock the closed state. Reference numerals 59 denote stoppers which engage with engaging notches 60 of the frame members 46, 47 for inhibiting the frame members 46, 47 from moving in their axial directions when assembled to the base 52.

Note that it is also adoptable to configure that the locking portions 58*a*, 58*a* of the locking means 58 engage with the first engaging protruding portions 57 of the partitions 50.

Fifth Embodiment

Figure 23:
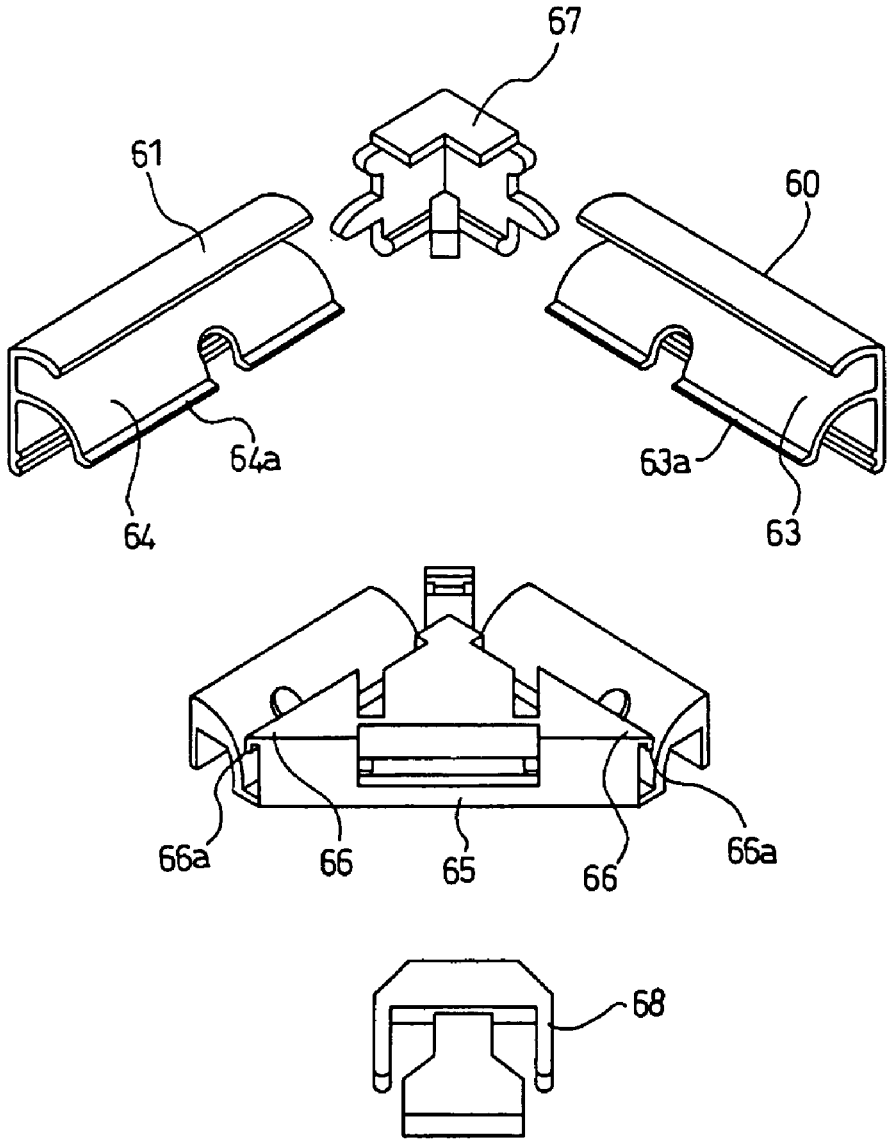
FIG. 23 is an exploded perspective view showing further another embodiment of the connecting device for the frame members according to the present invention.
Figure 24:
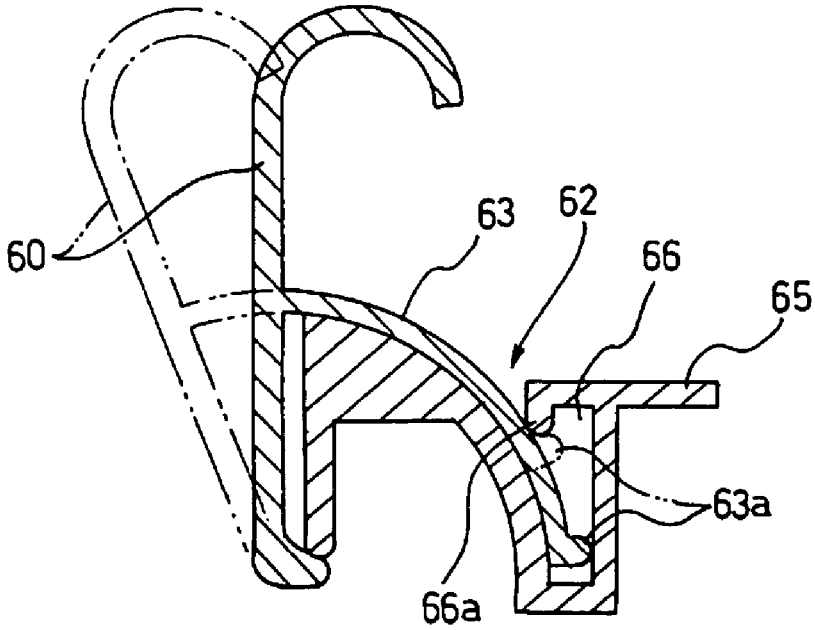
FIG. 24 is an explanatory view for explaining an operation of the connecting device for the frame members shown in FIG. 23.

FIG. 23 and FIG. 24 show further another embodiment of the opening stop means of the connecting device for the frame members of the frame according to the present invention. Referring to the drawings, opening stop means 62 of frame members 60, 61 according to this embodiment are constituted of engaging portions 63*a*, 64*a* provided outside tips of partitions 63, 64 of the frame members 60, 61, and arresting pieces 66, 66 provided with engaging protruding portions 66*a*, 66*a* provided protruding downward from the upper end on the side where a base 65 opposes the frame members 60, 61. Note that a reference numeral 67 denotes a corner member, and a reference numeral 68 denotes a locking means.

Therefore, when the frame members 60, 61 are opened from the base 65 when placing or replacing a not-shown showpiece to the fame, the engaging portion 63*a*, 64*a* (only one of them is shown) of the partition 63, 64 (only one of them is shown) of the frame member 60, 61 (only one of them is shown) engages with the engaging protruding portion 66*a*, 66*a* (only one of them is shown) of the arresting piece 66, 66 (only one of them is shown) as shown in FIG. 24 in particular to thereby stop the opening at a predetermined open angle. Note that a mechanical arresting means when the frame member 60, 61 is closed is the same as that of the preceding embodiments. Further, a possible configuration of another means to provide the arresting piece 66, 66 is that a plate is attached to the top face of the base 65 in which an arresting piece may be provided on the edge portion of the plate.

Separately from a frame member, a corner member with its corner smoothed is provided to facilitate an assembly work of the frame member to the corner member, and the corner member is configured to be openable/closable together with the frame member, thereby presenting less possibility of hurting a hand than by a conventional one in which end portions of frame members form a corner portion and facilitating attachment/detachment of the showpiece to/from the frame. Therefore, the frame is increased in convenience and thus applicable to exhibition of various showpieces.

What is claimed is:

1. A connecting device for frame members of a frame for connecting each corner portion of a plurality of frame members constituting a frame, said connecting device comprising:

a base to which an end portion of each of said frame members is attached to be rotatable in a direction perpendicular to an axial direction thereof;

a locking means attached to said base for locking said each frame member in an inwardly closed state; and a corner member with a smoothed corner which forms each corner portion of said frame, wherein said corner member is swingably attached to said base.

2. The connecting device for frame members of a frame according to claim 1, wherein said corner member is configured to be automatically opened when said corner member is released by the end portion of said frame member.

3. The connecting device for frame members of a frame according to claim 1, wherein said corner member has an arresting piece arrested to the end portion of said frame member, and engagement between the arresting piece and the end portion of said frame member is not released when said corner member and said frame member are opened.

4. The connecting device for frame members of a frame according to claim 1, further comprising, between said frame member and said base, a closing stop means for stopping said frame member at a predetermined closed position, said closing stop means being a stopper piece which is provided to protrude from said base and butts against said frame member.

5. The connecting device for frame members of a frame according to claim 1, further comprising, between said frame member and said base, an opening stop means for stopping said frame member at a predetermined open position, said opening stop means comprising a pivotal attachment recess of said frame member and an extended portion for forming on said base a hinge shaft portion for pivotally attaching the pivotal attachment recess thereto.

6. The connecting device for frame members of a frame according to claim 1, further comprising means for preventing said frame member that is pivotally attached to a hinge shaft portion from slipping off in an axial direction from said hinge shaft portion, said means being provided between said hinge shaft portion and said frame member.

7. The connecting device for frame members of a frame according to claim 1, wherein said base is provided with an abutting portion to which the end portion of said frame member butts.

8. The connecting device for frame members of a frame according to claim 1, further comprising, between said base and said corner member, an opening stop means for stopping said corner member at a predetermined open position, wherein said opening stop means is constituted of an engaging tongue piece attached to said corner member and having an engaging portion at a tip thereof and an engagement guide portion provided on said base for guiding and arresting the engaging tongue piece.

9. The connecting device for frame members of a frame according to claim 1, further comprising, between said frame member and said base, an opening stop means for stopping said frame member at a predetermined open position, wherein said opening stop means is constituted of an engaging portion provided at a tip of a partition of said frame member and an arresting piece provided to protrude in a horizontal direction on said base to engage with the engaging portion.

10. A connecting device for frame members of a frame for connecting each corner portion of a plurality of frame members constituting a frame said connecting device comprising:

a base to which an end portion of each of said frame members is attached to be rotatable in a direction perpendicular to an axial direction thereof;

a locking means attached to said base for locking said each frame member in an inwardly closed state; and an opening stop means for stopping said frame member in an open state, wherein said locking means is constituted of an accommodating hole provided in said base in a horizontal direction and having engaging portions, a locking plate slidably inserted in said accommodating hole, locking portions provided at tips of an arrow shape are engaged with the upper side of said frame members, and arresting portions provided at said locking plate for engaging with said engaging portions;

wherein said opening stop means is constituted of a pivotal attachment recess provided at said frame member, a hinge shaft portion for pivotally attaching the pivotal attachment recess thereto, and an extended portion provided on said base for making said hinge shaft.

11. The connecting device for frame members of a frame according to claim 10, wherein said opening stop means is constituted of an engaging projection provided on a pivot guide portion of said base and an engaging portion provided inside a tip of a partition of said frame member to engage with the engaging projection at a predetermined open angle.

12. The connecting device for frame members of a frame according to claim 10, wherein said opening stop means is constituted of an engaging portion provided at a tip of a partition of said frame member and an arresting piece provided to protrude in a horizontal direction on said base to engage with the engaging portion.

* * * * *